US007178590B2

(12) United States Patent
Vargo, Jr. et al.

(10) Patent No.: US 7,178,590 B2
(45) Date of Patent: Feb. 20, 2007

(54) WELL FLUIDS AND METHODS OF USE IN SUBTERRANEAN FORMATIONS

(75) Inventors: Richard F. Vargo, Jr., Katy, TX (US); James F. Heathman, Katy, TX (US)

(73) Assignee: Halliburton Energy Services, Inc., Duncan, OK (US)

( * ) Notice: Subject to any disclaimer, the term of this patent is extended or adjusted under 35 U.S.C. 154(b) by 0 days.

(21) Appl. No.: 11/451,520

(22) Filed: Jun. 12, 2006

(65) Prior Publication Data

US 2006/0231251 A1 Oct. 19, 2006

Related U.S. Application Data

(62) Division of application No. 10/791,151, filed on Mar. 2, 2004, now Pat. No. 7,096,944.

(51) Int. Cl.

| | |
|---|---|
| ***E21B 33/16*** | (2006.01) |
| ***E21B 47/10*** | (2006.01) |
| *C09K 7/04* | (2006.01) |
| *C09K 7/06* | (2006.01) |

(52) U.S. Cl. ..... 166/250.12; 166/291; 175/42; 175/65; 507/140; 507/142; 507/925

(58) Field of Classification Search ..... 166/187, 166/250.12, 250.14, 291, 319, 371; 175/42, 175/65; 507/140, 142, 269, 273, 274, 925, 507/926; 436/27, 28, 29

See application file for complete search history.

(56) References Cited

U.S. PATENT DOCUMENTS

| | | | | |
|---|---|---|---|---|
| 3,174,561 | A * | 3/1965 | Sterrett | 175/65 |
| 3,385,358 | A * | 5/1968 | Shell | 166/244.1 |
| 4,252,193 | A | 2/1981 | Powers et al. | |
| 4,304,298 | A | 12/1981 | Sutton | |
| 4,370,166 | A | 1/1983 | Powers et al. | |
| 4,530,402 | A | 7/1985 | Smith et al. | |
| 4,790,180 | A | 12/1988 | Sinnokrot | |
| 5,030,366 | A | 7/1991 | Wilson et al. | |
| 5,113,943 | A | 5/1992 | Wilson et al. | |
| 5,783,822 | A | 7/1998 | Buchanan et al. | |
| 6,457,524 | B1 | 10/2002 | Roddy | |

(Continued)

FOREIGN PATENT DOCUMENTS

| | | |
|---|---|---|
| EP | 0779409 | 6/1997 |

OTHER PUBLICATIONS

W. C. McMordie, Jr., et al.; "Effect of Temperature and Pressure on the Density of Drilling Fluids"; SPE Paper 11114; 1982.

C.P. Leach and A.J. Adams; "A New Method for the Relief of Annular Heat-Up Pressures"; SPE Paper 25497; 1993.

(Continued)

*Primary Examiner*—George Suchfield

(74) *Attorney, Agent, or Firm*—Craig W. Roddy; Baker Botts, L.L.P.

(57) ABSTRACT

Improved well fluids that include hollow particles, and methods of using such improved well fluids in subterranean cementing operations are provided. Also provided are methods of cementing, methods of reducing annular pressure, and well fluid compositions. While the compositions and methods of the present invention are useful in a variety of subterranean applications, they may be particularly useful in deepwater offshore cementing operations.

20 Claims, 5 Drawing Sheets

U.S. PATENT DOCUMENTS

| | | | | |
|---|---|---|---|---|
| 6,457,528 | B1 | 10/2002 | Staudt | |
| 6,508,305 | B1 | 1/2003 | Brannon et al. | |
| 6,530,437 | B2 | 3/2003 | Maurer et al. | |
| 6,675,898 | B2 | 1/2004 | Staudt | |
| 6,722,434 | B2 | 4/2004 | Reddy et al. | |
| 6,906,009 | B2 | 6/2005 | Shinbach et al. | |
| 6,909,009 | B2 * | 6/2005 | Koridze | 556/22 |
| 7,073,584 | B2 * | 7/2006 | Reddy et al. | 166/293 |
| 2005/0076812 | A1 | 4/2005 | Reddy et al. | |
| 2005/0161262 | A1 * | 7/2005 | Jamison | 175/65 |
| 2005/0167108 | A1 * | 8/2005 | Chang et al. | 166/298 |

OTHER PUBLICATIONS

P. Oudemon, et al., "Field Trial Results of Annular Pressure Behavior in a High-Pressure/High-Temperature Well"; SPE Paper 26738; 1995.

Richard F. Vargo, Jr., et al.; "Practical and Successful Prevention of Annular Pressure Buildup on the Marlin Project"; SPE Paper 77473; 2002.

Roger Williamson, et al.; "Control of Contained-Annulus Fluid Pressure Buildup"; SPE Paper 79875; 2003.

Foreign communication from a related counterpart applicaiton dated Mar. 31, 2005.

* cited by examiner

WELL FLUIDS AND METHODS OF USE IN SUBTERRANEAN FORMATIONS

CROSS-REFERENCE TO RELATED APPLICATION

This application is a divisional patent application of commonly-owned U.S. patent application Ser. No. 10/791,151, filed Mar. 2, 2004, now U.S. Pat. No. 7,096,944 entitled "Improved Well Fluids and Methods of Use in Subterranean Formations," by Richard F. Fargo, et aL, which is incorporated by reference herein for all purposes.

BACKGROUND OF THE INVENTION

The present invention relates to improved well fluids that comprise hollow particles, and to methods of using such improved well fluids in subterranean cementing operations.

Subterranean cementing operations are commonly performed in connection with, e.g., subterranean well completion and remedial operations. For example, primary cementing operations often involve the cementing of pipe strings, such as casings and liners, in subterranean well bores. In performing primary cementing, hydraulic cement compositions are pumped into the annular space between the walls of a well bore and the exterior surface of the pipe string disposed therein. The cement composition is permitted to set in the annular space, thereby forming an annular sheath of hardened substantially impermeable cement therein that substantially supports and positions the pipe string in the well bore and bonds the exterior surface of the pipe string to the walls of the well bore. Remedial cementing operations may include activities such as plugging highly permeable zones or fractures in well bores, plugging cracks and holes in pipe strings, and the like.

Hydrocarbon production from a well is often initiated at some time after primary cementing has been completed. Hydrocarbon fluids are often at elevated temperatures as they flow through the well bore to be produced at the surface. Thus, production of hydrocarbons through the well bore towards the surface may transfer heat through the casing into the annular space. This tends to cause any fluids present in the annular space to expand. In wells where annular volume is fixed (e.g., wells having closed and/or trapped annuli), this expansion of annular fluid within the fixed annular volume may increase the pressure within the annulus, sometimes dramatically. This phenomenon, commonly referred to as "annular pressure buildup" (APB), may cause severe well bore damage, including damage to the cement sheath, the casing, tubulars, and other well bore equipment.

An annular space may become trapped (e.g., hydraulically sealed) in a number of ways. For example, an operator may close or trap an annulus by shutting a valve, or by energizing a seal, in such a manner that prevents or inhibits communication between fluids within the annulus and the environment outside the annulus. This may occur, inter alia, towards the end of a cementing operation, when all fluids (e.g., spacer fluids and cement compositions) have been circulated into place to the operator's satisfaction.

Operators have attempted to solve the problem of annular pressure buildup in a variety of ways. For example, operators have wrapped the casing (before its installation into the well bore) with syntactic foam, e.g., foam that comprises small, hollow glass particles that are filled with air at atmospheric pressure. The glass particles may collapse at a certain annular pressure, thereby providing extra volume that prevents or mitigates further pressure buildup within the annulus. However, this possible solution to the problem of annular pressure buildup has been problematic because the presence of the foam wrapping often causes a flow restriction during primary cementing of the casing within the well bore. The foam wrapping has also demonstrated a tendency in some cases to detach from the casing, or to otherwise become damaged, as the casing is installed.

Another method by which operators have attempted to solve the problem of annular pressure buildup has involved the placement of nitrified spacer fluids above the top of the cement in an annulus, to absorb the expansion of annular fluids. However, this can be problematic, because of logistical difficulties such as limited room for the required surface equipment, pressure limitations on pumping equipment and the well bore, and associated costs. Another difficulty associated with this method relates to problems that may be involved in circulating the nitrified spacer into place without losing returns while cementing. This method also may be problematic when cementing operations are conducted in remote geographic areas or other areas that lack sufficient access to certain specialized equipment that may be required for pumping energized fluids (e.g., a nitrified spacer fluid).

Operators have also attempted to address annular pressure buildup by installing one or more rupture disks in an outer casing string. Upon the onset of annular pressure buildup, the rupture disk may be permitted to fail, and thus permit relief of the excess pressure into the formation, rather than into the well bore. This may allow the operator to direct the failure of the casing outward, instead of inward, where it could collapse the casing and tubulars. However, this method is problematic for a variety of reasons, including the difficulty that may arise in placing the rupture disks in a location where communication with a subterranean formation may occur, and the possibility that the casing string may become so compromised after the failure of the rupture disk that future well bore operations or events may be precluded.

Operators also have sought to deal with the problem of annular pressure buildup by intentionally designing the primary cementing operation to provide a "shortfall" of cement, e.g., the top of the cement column installed in an annulus is designed to fall slightly short of the shoe belonging to a preceding casing string. However, this method may create an undesirable structural weakness in the well bore. Furthermore, this method may create the possibility that the designed shortfall undesirably may cause the formation to fracture; the difficulty in precisely determining the magnitude of the formation's fracture gradient may exacerbate this possible difficulty. Additionally, the annulus may become trapped by cement due to channeling that may be caused by poor displacement, or by annular bridging of, inter alia, drill cuttings that may remain in the drilling fluid, and other solids normally associated with drilling fluids (e.g., barite, hematite, and the like).

SUMMARY OF THE INVENTION

The present invention relates to improved well fluids that comprise hollow particles, and to methods of using such improved well fluids in subterranean cementing operations.

An example of a method of the present invention is a method of cementing in a subterranean formation comprising the steps of: providing a well fluid that comprises a base fluid and a portion of hollow particles; placing the well fluid in a subterranean annulus; permitting at least a portion of the well fluid to become trapped within the annulus; providing a cement composition; placing the cement composition in the annulus; and permitting the cement composition to set therein.

Another example of a method of the present invention is a method of affecting pressure buildup in an annulus in a subterranean formation comprising placing within the annulus a well fluid comprising a base fluid and hollow particles, wherein at least a portion of the hollow particles collapse or reduce in volume so as to affect the annular pressure.

An example of a composition of the present invention is an annular-pressure-affecting well fluid comprising a base fluid and hollow particles, wherein at least a portion of the hollow particles may collapse or reduce in volume so as to affect the pressure in an annulus.

The features and advantages of the present invention will be readily apparent to those skilled in the art upon a reading of the description of the preferred embodiments that follows.

BRIEF DESCRIPTION OF THE DRAWINGS

A more complete understanding of the present disclosure and advantages thereof may be acquired by referring to the following description taken in conjunction with the accompanying drawings, wherein.

Figure 1:
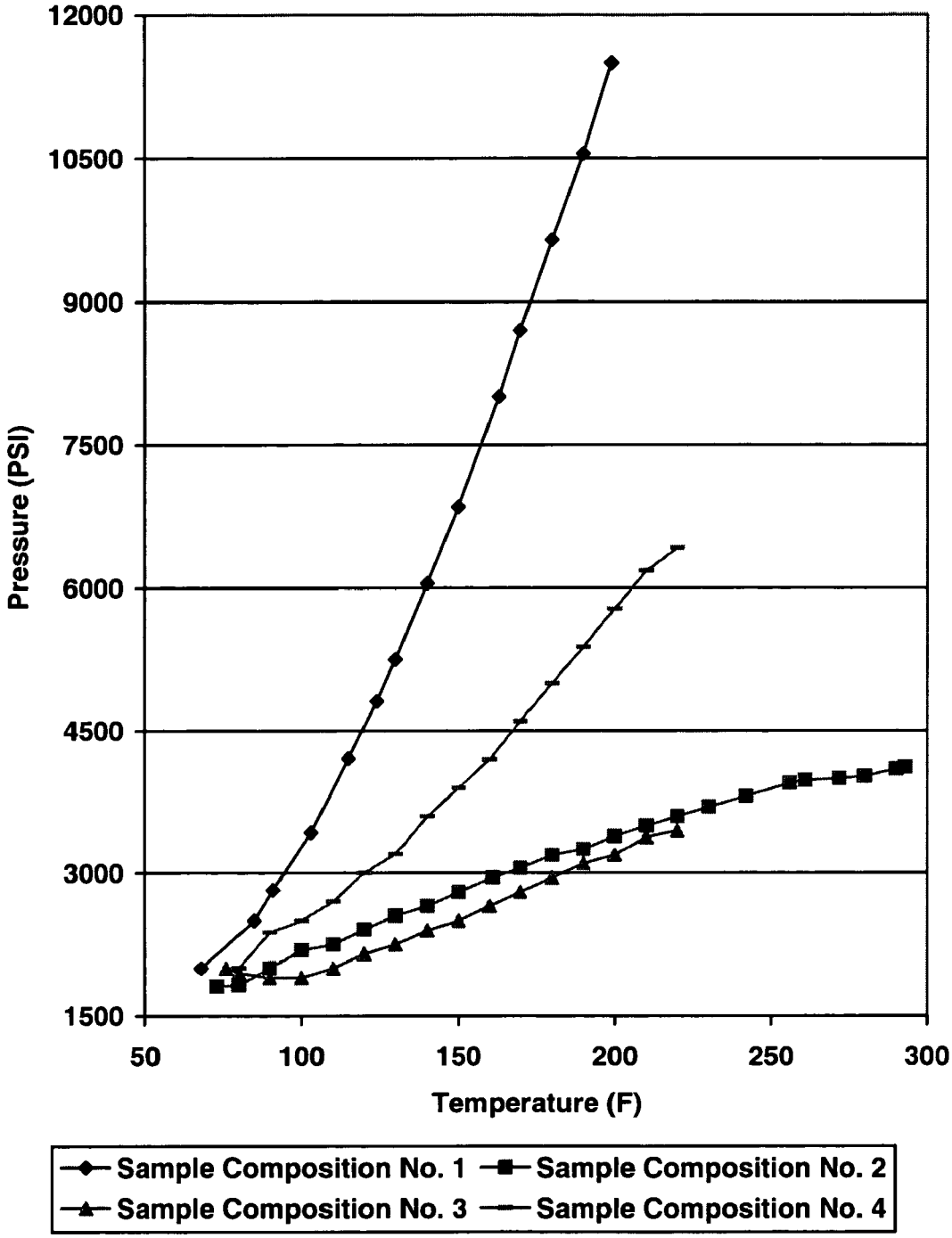
FIG. 1 illustrates a graphical representation of the results of a pressure response test performed on a variety of spacer fluids, including exemplary embodiments of the spacer fluids of the present invention.

While the present invention is susceptible to various modifications and alternative forms, specific exemplary embodiments thereof have been shown in the drawings and are herein described. It should be understood, however, that the description herein of specific embodiments is not intended to limit or define the invention to the particular forms disclosed, but on the contrary, the intention is to cover all modifications, equivalents, and alternatives falling within the spirit and scope of the invention as described by the appended claims.

DESCRIPTION OF EXEMPLARY EMBODIMENTS

The present invention relates to improved well fluids that comprise hollow particles, and to methods of using such improved well fluids in subterranean cementing operations. While the compositions and methods of the present invention are useful in a variety of subterranean applications, they may be particularly useful in deepwater offshore cementing operations.

The well fluids of the present invention typically comprise a base fluid and a portion of hollow particles. Generally, the well fluids of the present invention may be any fluid that may, or that is intended to, become trapped within a subterranean annulus after the completion of a subterranean cementing operation. In certain exemplary embodiments, the well fluid is a drilling fluid, a spacer fluid, or a completion fluid. In certain exemplary embodiments, the well fluid is a spacer fluid.

The base fluid used in the well fluids of the present invention may comprise an aqueous-based fluid or a nonaqueous-based fluid. Where the base fluid is aqueous-based, the base fluid can comprise fresh water, salt water (e.g., water containing one or more salts dissolved therein), brine (e.g., saturated salt water), or seawater. Nonlimiting examples of nonaqueous-based fluids that may be suitable include diesel, crude oil, kerosene, aromatic and nonaromatic mineral oils, olefins, and various other carriers and blends of any of the preceding examples such as paraffins, waxes, esters, and the like. Generally, the base fluid may be present in the well fluid in an amount sufficient to form a pumpable well fluid. More particularly, the base fluid is typically present in the well fluid in an amount in the range of from about 20% to about 99% by volume.

The hollow particles used in the well fluids typically comprise any material that may collapse or reduce in volume to a desired degree upon exposure to a force. For example, such force may be a compressive force generated by expansion of another fluid within a trapped annulus; such a force may occur due to an increase in the annular temperature stimulated by production of hydrocarbons from a subterranean formation. This collapse or reduction in volume of the hollow particles may, inter alia, provide a desired amount of expansion volume for other fluids within an annulus, e.g., a spacer fluid, preflush fluid, drilling fluid, or completion fluid composition, and may desirably affect the pressure in the annulus. The desired collapse or volume reduction of the hollow particles may be achieved by any suitable means, including, but not limited to, failure of the particle, or deformation and contraction of the particle. Generally, the hollow particles should be able to withstand the rigors of being pumped and should remain intact until after their placement in a subterranean annulus. An example of suitable hollow particles is commercially available from Halliburton Energy Services, Inc., under the tradename "SPHERELITE," which generally is obtained from the waste stream of coal-burning processes. As a result, each batch of material may demonstrate a wide range of failure pressures. Another example of a suitable hollow particle is a synthetic borosilicate that is commercially available from 3M Corporation under the tradename "SCOTCHLITE®," having different failure pressure ratings in the range of from about 500 psi to about 18,000 psi. For example, SCOTCHLITE® HGS-4000, HGS-6000 and HGS-10,000 particles are hollow particles having failure pressure ratings of 4,000, 6,000, and 10,000 psi, respectively. Once exposed to a pressure above their pressure rating, SCOTCHLITE® hollow particles demonstrate a predictable failure rate, which may provide, inter alia, a suitable and predictable amount of expansion volume for other fluids within the annulus, thereby reducing or mitigating annular pressure buildup.

Generally, the hollow particles will be present in the well fluids of the present invention in an amount sufficient to provide a desired amount of expansion volume, upon collapse or reduction in volume of the hollow particles, for other fluids within an annulus. The concentration of hollow particles in the well fluids of the present invention may depend on factors including, inter alia, the magnitude of the anticipated pressure buildup in a particular annulus, the volume in the subterranean annulus that the operator may allocate for placement and trapping of the well fluid, and the volume relief that may be provided by a particular volume of hollow particles. The magnitude of the anticipated pressure buildup in a particular annulus may be determined by performing calculations available to those of ordinary skill in the art. In certain exemplary embodiments of the present invention, an operator may determine the approximate amount of volume relief needed to prevent an undesirable buildup of pressure in a subterranean annulus; then, knowing the amount of volume relief that a hollow particle may provide, the operator may calculate the requisite volume of hollow particles that may provide the desired volume relief. In certain exemplary embodiments wherein an operator may have a limited amount of volume in a subterranean annulus that may be allocated for placement and trapping of the well fluid, the incorporation of the requisite volume of hollow particles needed to provide the desired volume relief may result in a relatively higher concentration of hollow particles in the well fluid than in certain exemplary embodiments wherein the operator is not limited in the amount of volume in the annulus that may be allocated for placement and trapping of the well fluid. In certain exemplary embodiments, the hollow particles may be present in the well fluid in an amount in the range of from about 1% to about 80% by volume of the well fluid. In certain exemplary embodiments, the hollow particles may be present in the well fluid in an amount in the range of from about 10% to about 60% by volume of the well fluid.

Optionally, the well fluids of the present invention may be foamed well fluids that comprise a gas-generating additive. The gas-generating additive may generate a gas in situ at a desired time. The inclusion of the gas-generating additive in the well fluids of the present invention may further assist in mitigating annular pressure buildup, through compression of the gas generated by the gas-generating additive. Nonlimiting examples of suitable gas-generating additives include aluminum powder (which may generate hydrogen gas) and azodicarbonamide (which may generate nitrogen gas). The reaction by which aluminum generates hydrogen gas in a well fluid is influenced by, inter alia, the alkalinity of the well fluid, and generally proceeds according to the following reaction:

$$2Al(s)+2OH^-(aq)+6H_2O \rightarrow 2Al(OH)_4^-(aq)+3H_2(g)$$

An example of a suitable gas-generating additive is an aluminum powder that is commercially available from Halliburton Energy Services, Inc., of Duncan, Okla., under the tradename "SUPER CBL." SUPER CBL is available as a dry powder or as a liquid additive. Where present, the gas-generating additive may be included in the well fluid in an amount in the range of from about 0.2% to about 5% by volume of the well fluid. In certain exemplary embodiments, the gas-generating additive may be included in the well fluid in an amount in the range of from about 0.25% to about 3.8% by volume of the well fluid. The gas-generating additive may be added to the well fluid, inter alia, by dry blending it with the hollow particles or by injection into the well fluid as a liquid suspension while the well fluid is being pumped into the subterranean formation.

Optionally, the well fluids of the present invention may comprise a silicate, a metasilicate, or an acid pyrophosphate, inter alia, to facilitate displacement from a subterranean well bore of a drilling mud resident within the well bore. Nonlimiting examples of suitable silicates, metasilicates, and acid pyrophosphates include sodium silicate, sodium metasilicate, potassium silicate, potassium metasilicate, and sodium acid pyrophosphate. Examples of suitable sources of sodium silicate or potassium silicate include those aqueous solutions of sodium silicate or potassium silicate that are commercially available from Halliburton Energy Services, Inc., of Houston, Tex. under the tradenames "FLOW CHEK" and "SUPER FLUSH." Where included, silicates and metasilicates may be present in the well fluid in an amount in the range of from about 2% to about 12% by weight of the well fluid. Nonlimiting examples of suitable sources of sodium acid pyrophosphate include those that are commercially available from Halliburton Energy Services, Inc., of Houston, Tex. under the tradename "MUD FLUSH." Where included, the acid pyrophosphate may be present in the well fluid in an amount in the range of from about 1% to about 10% by weight of the well fluid.

Optionally, the well fluids of the present invention may comprise a tracer, inter alia, to indicate placement of the well fluid at a desired location in a well bore. Examples of suitable tracers include fluorescein dyes and tracer beads. Alternatively, an operator may elect not to include the tracer in the well fluids of the present invention, but may prefer instead to circulate a separate "tracer pill" into the well bore ahead of the well fluids of the present invention. In certain exemplary embodiments of the methods of the present invention where an operator makes such election to circulate a separate tracer pill, the volume of the tracer pill will generally be in the range of from about 10 to about 100 barrels, depending on factors such as, inter alia, the length and cross-sectional area of the well bore. In certain exemplary embodiments of the methods of the present invention where an operator circulates a separate tracer pill into a well bore before placing a well fluid of the present invention into the well bore, the arrival of the tracer pill at a desired location (e.g., the emergence of the tracer pill at the surface) may inform the operator that the well fluids of the present invention themselves have arrived at a desired location in the well bore.

Optionally, the well fluids of the present invention may comprise other additives, including, but not limited to, viscosifiers, oxidizers, surfactants, fluid loss control additives, dispersants, weighting materials, or the like. An example of a suitable oxidizer is commercially available from Halliburton Energy Services, Inc., of Houston, Tex., under the tradename "PHPA Preflush." In certain exemplary embodiments in which the well fluid comprises a hollow particle that may collapse or crush upon exposure to a particular annular pressure, the inclusion of a surfactant in the well fluids of the present invention may enhance the well fluid's ability to entrain air released by the crushing of the hollow particle by inhibiting the rate of bubble coalescence.

The well fluids of the present invention may be placed in a subterranean annulus in any suitable fashion. For example, the well fluids of the present invention may be placed into the annulus directly from the surface. Alternatively, the well fluids of the present invention may be flowed into a well bore via the casing and permitted to circulate into place in the annulus between the casing and the subterranean formation. Generally, an operator will circulate one or more additional fluids (e.g., a cement composition) into place within the subterranean annulus behind the well fluids of the present invention therein; in certain exemplary embodiments, the additional fluids do not mix with the well fluids of the present invention. At least a portion of the well fluids of the present invention then may become trapped within the subterranean annulus; in certain exemplary embodiments of the present invention, the well fluids of the present invention may become trapped at a point in time after a cement composition has been circulated into a desired position within the annulus to the operator's satisfaction. At least a portion of the hollow particles of the well fluids of the present invention may collapse or reduce in volume so as to affect the pressure in the annulus. For example, if the temperature in the annulus should increase after the onset of hydrocarbon production from the subterranean formation, at least a portion of the hollow particles may collapse or reduce in volume so as to desirably mitigate, or prevent, an undesirable buildup of pressure within the annulus.

An example of a composition of the present invention is a well fluid comprising 70% water by volume and 30% hollow particles by volume. Another example of a composition of the present invention is a well fluid comprising 65% water by volume, 10% sodium silicate by volume, and 25% hollow particles by volume.

An example of a method of the present invention is a method of cementing in a subterranean formation comprising the steps of: providing a well fluid that comprises a base fluid and a portion of hollow particles; placing the well fluid in a subterranean annulus; permitting at least a portion of the well fluid to become trapped within the annulus; providing a cement composition; placing the cement composition in the annulus; and permitting the cement composition to set therein. In certain exemplary embodiments of the present invention, the step of permitting at least a portion of the well fluid to become trapped within the annulus occurs after the step of placing the cement composition in a subterranean annulus. In certain exemplary embodiments of the present invention, the step of permitting at least a portion of the well fluid to become trapped within the annulus occurs after the step of placing the cement composition in a subterranean annulus, and before the step of permitting the cement composition to set within the subterranean annulus. Additional steps may include, inter alia, placing a tracer pill into the subterranean annulus before the step of placing the well fluid in a subterranean annulus; and observing the arrival of the tracer pill at a desired location before the step of permitting the cement composition to set within the subterranean annulus.

Another example of a method of the present invention is a method of affecting pressure buildup in an annulus in a subterranean formation comprising placing within the annulus a well fluid comprising a base fluid and hollow particles, wherein at least a portion of the hollow particles collapse or reduce in volume so as to affect the annular pressure.

To facilitate a better understanding of the present invention, the following examples of preferred embodiments are given. In no way should the following examples be read to limit, or to define, the scope of the invention.

EXAMPLES

Sample fluid compositions were prepared comprising water and a volume of hollow particles. The sample fluid compositions initially comprised 500 mL of water, to which a solution of 280 mL water and a portion of hollow particles were added. The portion of hollow particles added to each sample composition was sized such that the portion of hollow particles comprised about 39% by volume of each sample composition. After each sample composition was prepared, it was placed in a high temperature high pressure ("HTHP") cell and pressurized to about 2,000 psi. This pressure is believed to be representative of the initial placement pressure typical of at least some well bore installations. The temperature of the HTHP cell was elevated from room temperature to temperatures that are believed to be representative of those that may be encountered in at least some casing annuli due to, inter alia, production operations.

Sample Composition No. 1 comprised only water.

Sample Composition No. 2 comprised a total of 780 mL of water and 190 grams of SCOTCHLITE HGS-4000 hollow particles.

Sample Composition No. 3 comprised a total of 780 mL of water and 229 grams of SCOTCHLITE HGS-6000 hollow particles.

Sample Composition No. 4 comprised a total of 780 mL of water and 300 grams of SCOTCHLITE HGS-10000 hollow particles.

The results of the test are set forth in the tables below, as well as in FIG. 1.

TABLE 1

Sample Composition No. 1

| Temperature (° F.) | Pressure (psi) |
|---|---|
| 68 | 2000 |
| 85 | 2500 |
| 91 | 2820 |
| 103 | 3430 |
| 115 | 4210 |
| 124 | 4810 |
| 130 | 5250 |
| 140 | 6050 |
| 150 | 6850 |
| 163 | 8010 |
| 170 | 8700 |
| 180 | 9650 |
| 190 | 10550 |
| 199 | 11500 |

TABLE 2

Sample Composition No. 2

| Temperature (° F.) | Pressure (psi) |
|---|---|
| 73 | 1810 |
| 80 | 1820 |
| 90 | 2000 |
| 100 | 2190 |
| 110 | 2250 |
| 120 | 2410 |
| 130 | 2550 |
| 140 | 2650 |
| 150 | 2800 |
| 161 | 2950 |
| 170 | 3050 |
| 180 | 3190 |
| 190 | 3250 |
| 200 | 3390 |
| 210 | 3500 |
| 220 | 3600 |
| 230 | 3700 |
| 242 | 3810 |
| 256 | 3950 |
| 261 | 3980 |
| 272 | 4000 |
| 280 | 4025 |
| 290 | 4100 |
| 293 | 4120 |

TABLE 3

Sample Composition No. 3

| Temperature (° F.) | Pressure (psi) |
|---|---|
| 76 | 2000 |
| 80 | 1950 |
| 90 | 1900 |

TABLE 3-continued

| Sample Composition No. 3 | |
|---|---|
| Temperature (° F.) | Pressure (psi) |
| 100 | 1900 |
| 110 | 2000 |
| 120 | 2150 |
| 130 | 2250 |
| 140 | 2400 |
| 150 | 2500 |
| 160 | 2650 |
| 170 | 2800 |
| 180 | 2950 |
| 190 | 3100 |
| 200 | 3190 |
| 210 | 3380 |
| 220 | 3450 |

TABLE 4

| Sample Composition No. 4 | |
|---|---|
| Temperature (° F.) | Pressure (psi) |
| 76 | 2000 |
| 80 | 2100 |
| 90 | 2380 |
| 100 | 2500 |
| 110 | 2700 |
| 120 | 3000 |
| 130 | 3200 |
| 140 | 3600 |
| 150 | 3900 |
| 160 | 4200 |
| 170 | 4600 |
| 180 | 5000 |
| 190 | 5380 |
| 200 | 5780 |
| 210 | 6180 |
| 220 | 6420 |

The above example suggests, inter alia, that the well fluids of the present invention comprising a portion of hollow particles may desirably mitigate pressure buildup in a trapped annulus.

Example 2

Sample fluid compositions were prepared comprising water and a volume of hollow particles. The sample fluid compositions initially comprised 750 mL of water, to which a solution of 280 mL water and a portion of hollow particles were added. The portion of hollow particles added to each sample composition was sized such that the portion of hollow particles comprised about 19.5% by volume of each sample composition. After each sample composition was prepared, it was placed in a high temperature high pressure ("HTHP") cell and pressurized to about 2,000 psi. This pressure is believed to be representative of the initial placement pressure typical of at least some well bore installations. The temperature of the HTHP cell was elevated from room temperature to temperatures that are believed to be representative of those that may be encountered in at least some casing annuli due to, inter alia, production operations.

Sample Composition No. 5 comprised a total of 1,030 mL of water and 95 grams of SCOTCHLITE HGS-4000 hollow particles.

Sample Composition No. 6 comprised a total of 1,030 mL of water and 114.9 grams of SCOTCHLITE HGS-6000 hollow particles.

Sample Composition No. 7 comprised a total of 1,030 mL of water and 150 grams of SCOTCHLITE HGS-10000 hollow particles.

Figure 2:
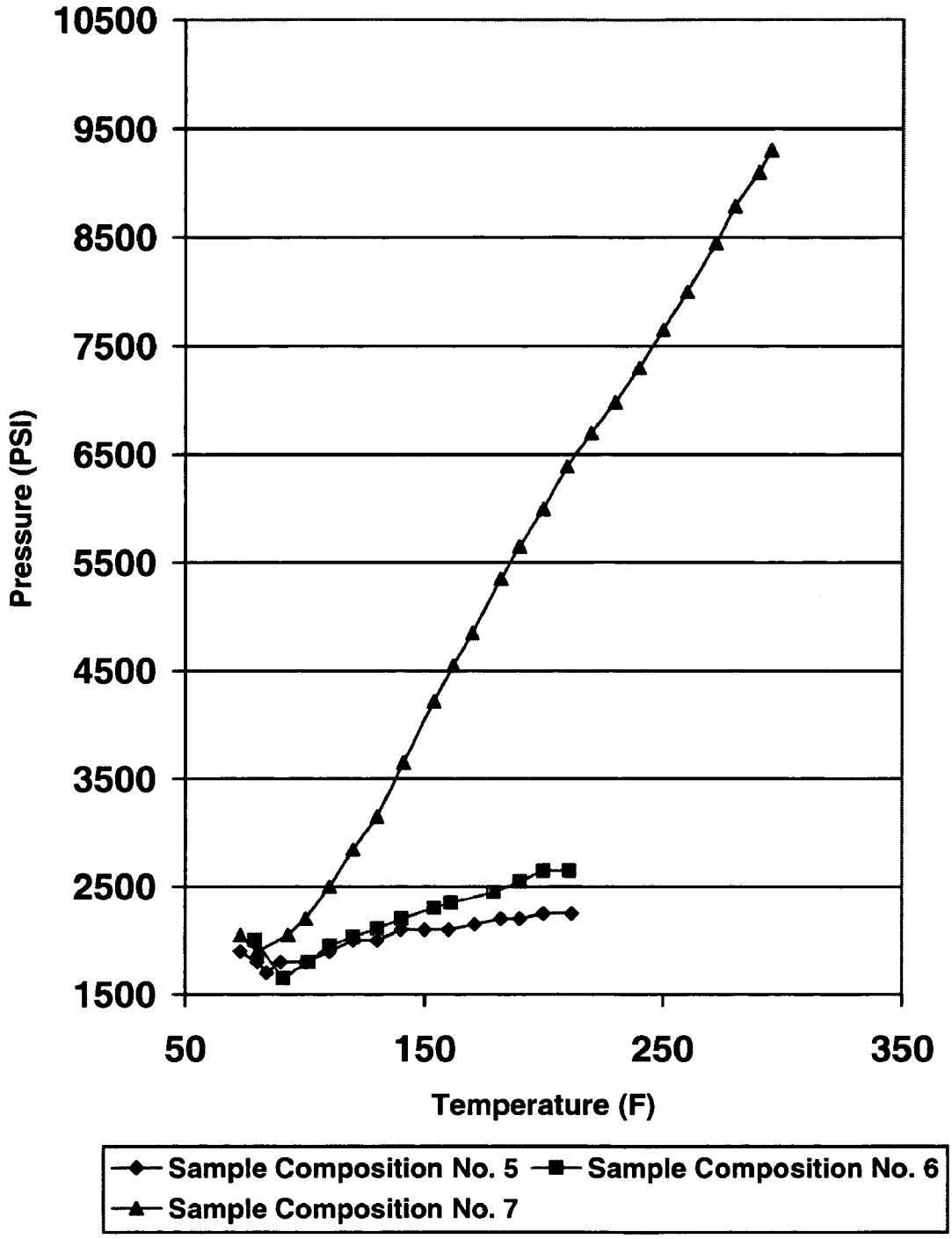
FIG. 2 illustrates a graphical representation of the results of a pressure response test performed on exemplary embodiments of the spacer fluids of the present invention.

The results of the test are set forth in the tables below, as well as in FIG. 2.

TABLE 5

| Sample Composition No. 5 | |
|---|---|
| Temperature (° F.) | Pressure (psi) |
| 73 | 1900 |
| 80 | 1800 |
| 84 | 1700 |
| 90 | 1800 |
| 100 | 1800 |
| 110 | 1900 |
| 120 | 2000 |
| 130 | 2000 |
| 140 | 2100 |
| 150 | 2100 |
| 160 | 2100 |
| 171 | 2150 |
| 182 | 2200 |
| 190 | 2200 |
| 200 | 2250 |
| 212 | 2250 |

TABLE 6

| Sample Composition No. 6 | |
|---|---|
| Temperature (° F.) | Pressure (psi) |
| 79 | 2000 |
| 91 | 1650 |
| 101 | 1800 |
| 110 | 1950 |
| 120 | 2030 |
| 130 | 2110 |
| 140 | 2200 |
| 154 | 2300 |
| 161 | 2350 |
| 179 | 2450 |
| 190 | 2550 |
| 200 | 2650 |
| 211 | 2650 |

TABLE 7

| Sample Composition No. 7 | |
|---|---|
| Temperature (° F.) | Pressure (psi) |
| 73 | 2050 |
| 80 | 1890 |
| 93 | 2050 |
| 100 | 2200 |
| 110 | 2500 |
| 120 | 2850 |
| 130 | 3150 |
| 141 | 3650 |
| 154 | 4220 |
| 162 | 4550 |
| 170 | 4850 |
| 182 | 5350 |
| 190 | 5650 |
| 200 | 6000 |
| 210 | 6390 |
| 220 | 6700 |
| 230 | 6980 |
| 240 | 7300 |
| 250 | 7650 |
| 260 | 8000 |
| 272 | 8450 |

TABLE 7-continued

| Sample Composition No. 7 | |
|---|---|
| Temperature (° F.) | Pressure (psi) |
| 280 | 8790 |
| 290 | 9100 |
| 295 | 9300 |

The above example suggests, inter alia, that the well fluids of the present invention comprising a portion of hollow particles desirably may mitigate pressure buildup in a trapped annulus.

Example 3

A sample fluid composition was prepared comprising about 230 mL of water. Sample Composition No. 8 was then placed in an Ultrasonic Cement Analyzer that is commercially available from Fann Instruments, Inc., of Houston, Tex. Once within the Ultrasonic Cement Analyzer, Sample Composition No. 8 was pressurized to about 2,500 psi. This pressure is believed to be representative of the initial placement pressure typical of at least some well bore installations. The temperature of the HTHP cell was elevated from room temperature to temperatures that are believed to be representative of those that may be encountered in at least some casing annuli due to, inter alia, production operations.

Figure 3:
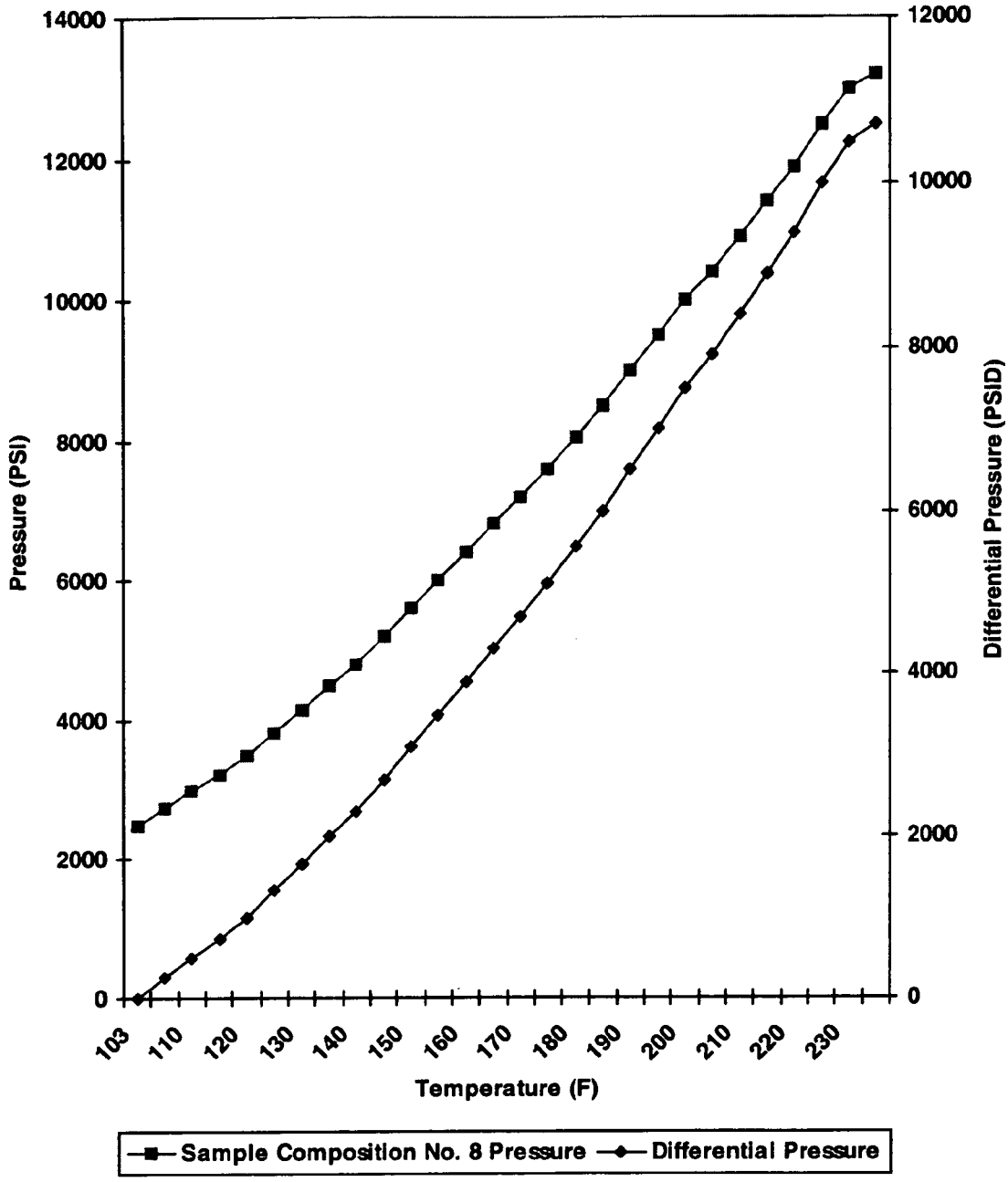
FIG. 3 illustrates a graphical representation of the results of a pressure response test performed on a spacer fluid that comprises only water.

The results of the test are set forth in the table below, as well as in FIG. 3.

TABLE 8

| Sample Composition No. 8 | | |
|---|---|---|
| Temperature (° F.) | Pressure (psi) | Differential Pressure (psid) |
| 103 | 2500 | 0 |
| 105 | 2750 | 250 |
| 110 | 3000 | 500 |
| 115 | 3225 | 725 |
| 120 | 3500 | 1000 |
| 125 | 3825 | 1325 |
| 130 | 4150 | 1650 |
| 135 | 4500 | 2000 |
| 140 | 4800 | 2300 |
| 145 | 5200 | 2700 |
| 150 | 5600 | 3100 |
| 155 | 6000 | 3500 |
| 160 | 6400 | 3900 |
| 165 | 6800 | 4300 |
| 170 | 7200 | 4700 |
| 175 | 7600 | 5100 |
| 180 | 8050 | 5550 |
| 185 | 8500 | 6000 |
| 190 | 9000 | 6500 |
| 195 | 9500 | 7000 |
| 200 | 10000 | 7500 |
| 205 | 10400 | 7900 |
| 210 | 10900 | 8400 |
| 215 | 11400 | 8900 |
| 220 | 11900 | 9400 |
| 225 | 12500 | 10000 |
| 230 | 13000 | 10500 |
| 233 | 13200 | 10700 |

Thus, as Sample Composition No. 8 increased in temperature by 130 degrees F., its pressure increased by 10,700 psid, e.g., an increase of about 82.3 psi per degree F.

The above example suggests that a well fluid wholly comprising water may demonstrate an increase in pressure when exposed to increasing temperature in a trapped annulus.

Example 4

A sample fluid composition was prepared comprising water and a volume of hollow particles. Sample Composition No. 9 initially comprised 195.5 mL of water, to which 34.5 mL of SCOTCHLITE HGS-10000 hollow particles were added. The portion of hollow particles added was sized such that the portion of hollow particles comprised about 15% by volume of the sample composition. Sample Composition No. 9 was then placed in an Ultrasonic Cement Analyzer that is commercially available from Fann Instruments, Inc., of Houston, Tex. Once within the Ultrasonic Cement Analyzer, Sample Composition No. 9 was pressurized from 0 psi to about 11,000 psi over a period of about 22 minutes. Over the next 7 minutes, failure of some of the hollow particles reduced the pressure to about 10,600 psi. The pressure was then manually lowered to about 4,800 psi. Inter alia, this step of lowering the pressure to about 4,800 psi may approximate migration of the hollow particles to a well head. The temperature of Sample Composition No. 9 was then elevated from room temperature to temperatures that are believed to be representative of those that may be encountered in at least some casing annuli due to, inter alia, production operations.

Figure 4:
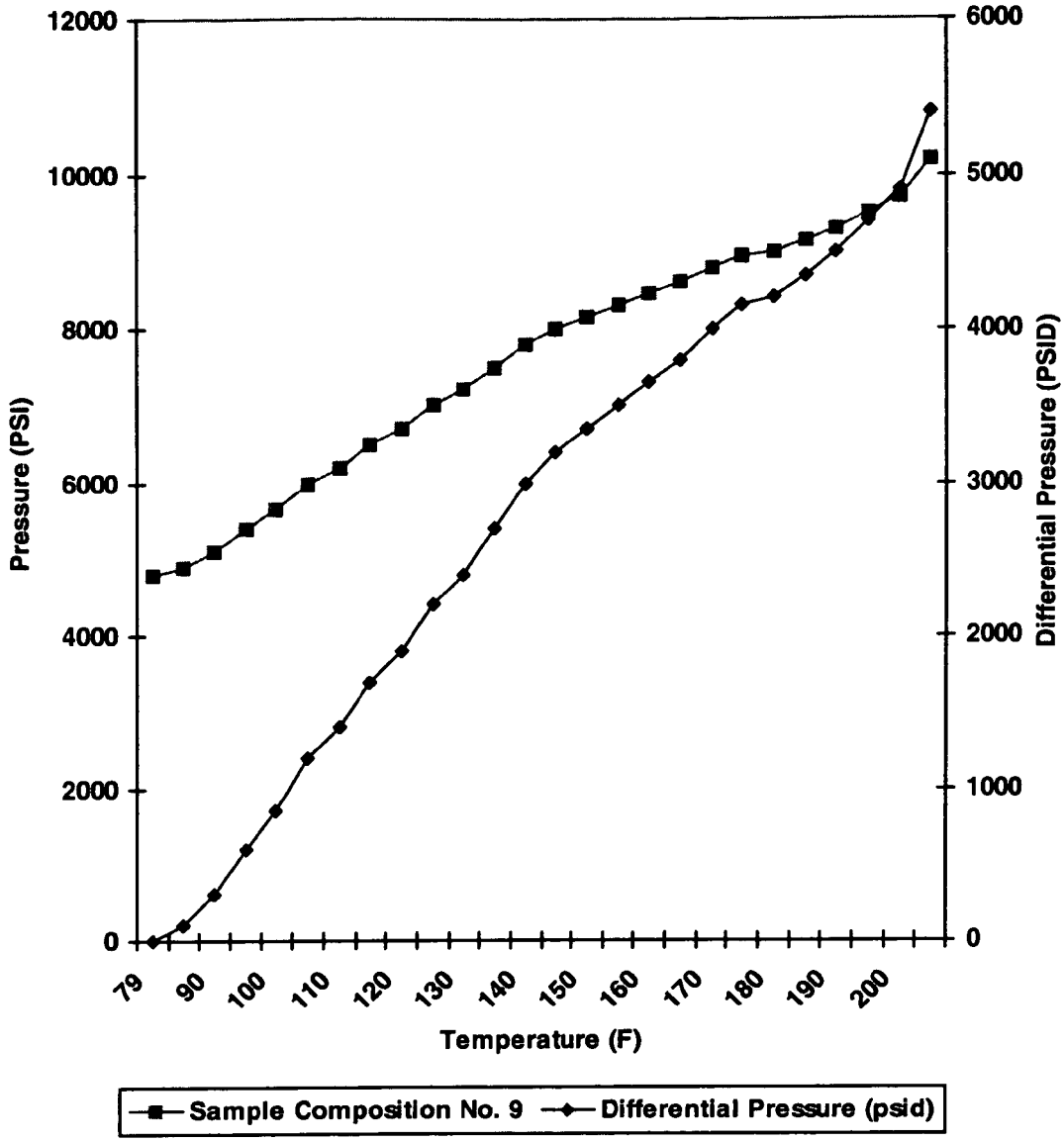
FIG. 4 illustrates a graphical representation of the results of a pressure response test performed on exemplary embodiments of the spacer fluids of the present invention.

The results of the test are set forth in the table below, as well as in FIG. 4.

TABLE 9

| Sample Composition No. 9 | | |
|---|---|---|
| Temperature (° F.) | Pressure (psi) | Differential Pressure (psid) |
| 79 | 4800 | 0 |
| 85 | 4900 | 100 |
| 90 | 5100 | 300 |
| 95 | 5400 | 600 |
| 100 | 5650 | 850 |
| 105 | 6000 | 1200 |
| 110 | 6200 | 1400 |
| 115 | 6500 | 1700 |
| 120 | 6700 | 1900 |
| 125 | 7000 | 2200 |
| 130 | 7200 | 2400 |
| 135 | 7500 | 2700 |
| 140 | 7800 | 3000 |
| 145 | 8000 | 3200 |
| 150 | 8150 | 3350 |
| 155 | 8300 | 3500 |
| 160 | 8450 | 3650 |
| 165 | 8600 | 3800 |
| 170 | 8800 | 4000 |
| 175 | 8950 | 4150 |
| 180 | 9000 | 4200 |
| 185 | 9150 | 4350 |
| 190 | 9300 | 4500 |
| 195 | 9500 | 4700 |
| 200 | 9700 | 4900 |
| 214 | 10200 | 5400 |

Thus, as Sample Composition No. 9 increased in temperature by 135 degrees F., its pressure increased by 5,400 psid, e.g., an increase of about 40 psi per degree F.

The above example suggests, inter alia, that the well fluids of the present invention comprising a portion of hollow particles desirably may mitigate pressure buildup in a trapped annulus.

Example 5

A sample fluid composition was prepared comprising water and a volume of hollow particles. Sample Composition No. 10 initially comprised 149.5 mL of water, to which 80.5 mL of SCOTCHLITE HGS-10000 hollow particles were added. The portion of hollow particles added was sized such that the portion of hollow particles comprised about 35% by volume of the sample composition. Sample Composition No. 10 was then placed in an Ultrasonic Cement Analyzer that is commercially available from Fann Instruments, Inc., of Houston, Tex. Once within the Ultrasonic Cement Analyzer, Sample Composition No. 10 was then pressurized from 0 psi to about 11,000 psi over a period of about 11 minutes. Over the next 8 minutes, failure of some of the hollow particles reduced the pressure to about 9,300 psi. The pressure was then manually lowered to about 4,100 psi. Among other things, this step of lowering the pressure to about 4,100 psi may approximate migration of the hollow particles to a well head. The temperature of Sample Composition No. 10 was then elevated from room temperature to temperatures that are believed to be representative of those that may be encountered in at least some casing annuli due to, among other things, production operations.

Figure 5:
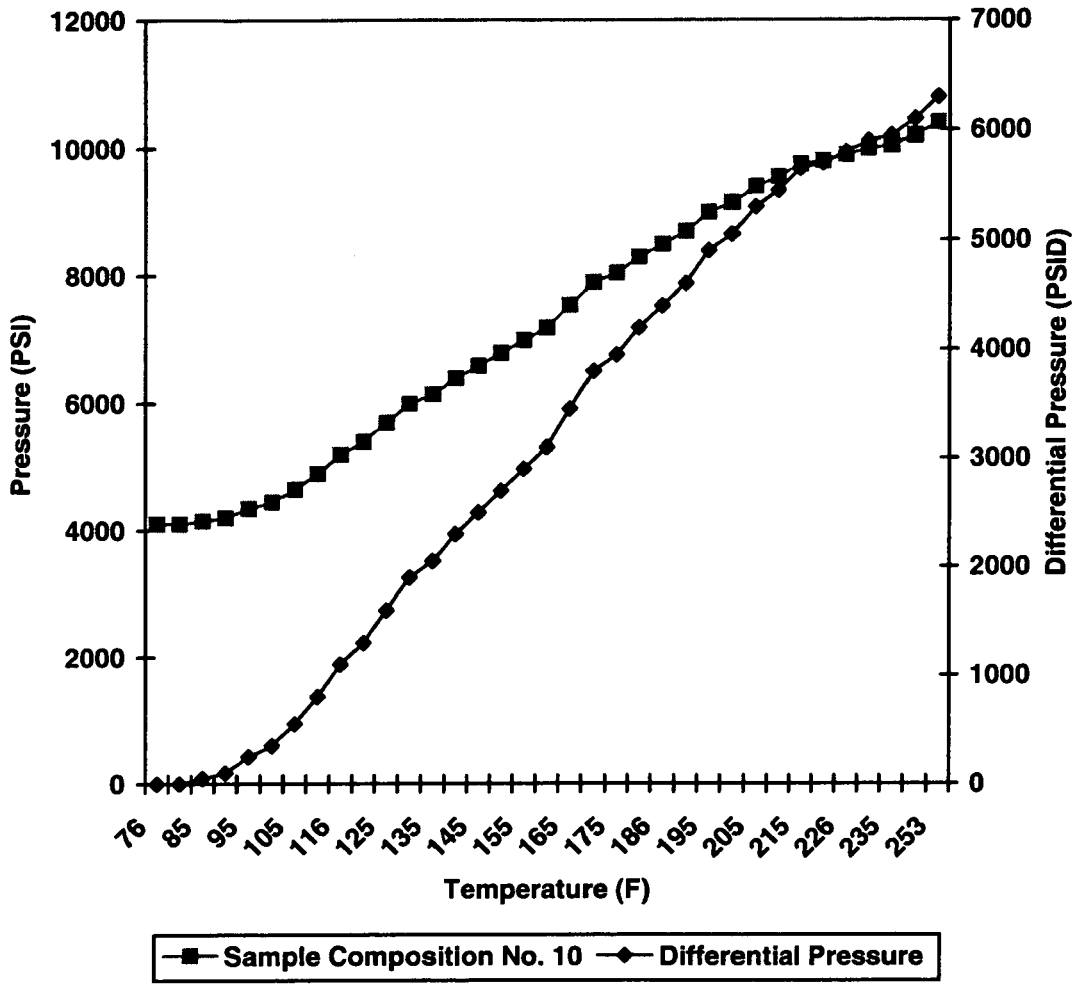
FIG. 5 illustrates a graphical representation of the results of a pressure response test performed on exemplary embodiments of the spacer fluids of the present invention.

The results of the test are set forth in the table below, as well as in FIG. 5.

TABLE 10

| Sample Composition No. 10 | | |
|---|---|---|
| Temperature (° F.) | Pressure (psi) | Differential Pressure (psid) |
| 76 | 4100 | 0 |
| 80 | 4100 | 0 |
| 85 | 4150 | 50 |
| 90 | 4200 | 100 |
| 95 | 4350 | 250 |
| 100 | 4450 | 350 |
| 105 | 4650 | 550 |
| 110 | 4900 | 800 |
| 116 | 5200 | 1100 |
| 120 | 5400 | 1300 |
| 125 | 5700 | 1600 |
| 130 | 6000 | 1900 |
| 135 | 6150 | 2050 |
| 141 | 6400 | 2300 |
| 145 | 6600 | 2500 |
| 150 | 6800 | 2700 |
| 155 | 7000 | 2900 |
| 160 | 7200 | 3100 |
| 165 | 7550 | 3450 |
| 170 | 7900 | 3800 |
| 175 | 8050 | 3950 |
| 180 | 8300 | 4200 |
| 186 | 8500 | 4400 |
| 191 | 8700 | 4600 |
| 195 | 9000 | 4900 |
| 200 | 9150 | 5050 |
| 205 | 9400 | 5300 |
| 210 | 9550 | 5450 |
| 215 | 9750 | 5650 |
| 220 | 9800 | 5700 |
| 226 | 9900 | 5800 |
| 230 | 10000 | 5900 |
| 235 | 10050 | 5950 |
| 240 | 10200 | 6100 |
| 253 | 10400 | 6300 |

Thus, as Sample Composition No. 10 increased in temperature by 177 degrees F., its pressure increased by 6,300 psid, e.g., an increase of about 35.6 psi per degree F.

The above example suggests, inter alia, that the well fluids of the present invention comprising a portion of hollow particles desirably may mitigate pressure buildup in a trapped annulus.

Therefore, the present invention is well adapted to carry out the objects and attain the ends and advantages mentioned as well as those which are inherent therein. While the invention has been depicted, described, and is defined by reference to exemplary embodiments of the invention, such a reference does not imply a limitation on the invention, and no such limitation is to be inferred. The invention is capable of considerable modification, alternation, and equivalents in form and function, as will occur to those ordinarily skilled in the pertinent arts and having the benefit of this disclosure. The depicted and described embodiments of the invention are exemplary only, and are not exhaustive of the scope of the invention. Consequently, the invention is intended to be limited only by the spirit and scope of the appended claims, giving full cognizance to equivalents in all respects.

What is claimed is:

1. A method of affecting annular pressure buildup in an annulus in a subterranean formation comprising placing within the annulus a well fluid comprising a base fluid and hollow particles, wherein at least a portion of the well fluid is permitted to become trapped in the annulus and wherein at least a portion of the hollow particles collapse or reduce in volume so as to mitigate or reduce the annular pressure.

2. The method of claim 1, wherein the well fluid is selected from the group consisting of a drilling fluid, a spacer fluid, and a completion fluid.

3. The method of claim 1, wherein the well fluid is a spacer fluid.

4. The method of claim 1, wherein the base fluid is an aqueous-based fluid or a nonaqueous-based fluid.

5. The method of claim 4 wherein the nonaqueous-based fluid is selected from the group consisting of: diesel, crude oil, kerosene, an aromatic mineral oil, a nonaromatic mineral oil, an olefin, and a mixture thereof.

6. The method of claim 1 wherein the base fluid is present in the well fluid in an amount sufficient to form a pumpable well fluid.

7. The method of claim 6 wherein the base fluid is present in the well fluid in an amount in the range of from about 20% to about 99% by volume.

8. The method of claim 1 wherein the hollow particles comprise a material that deforms upon exposure to a force.

9. The method of claim 8 wherein the material comprises a synthetic borosilicate.

10. The method of claim 8 wherein the deformation of the material upon exposure to the force reduces the volume of a hollow particle.

11. The method of claim 1 wherein the hollow particles are present in the well fluid in an amount sufficient to provide an amount of expansion volume for an annular fluid.

12. The method of claim 1 wherein the hollow particles are present in the well fluid in an amount in the range of from about 1% to about 80% by volume of the well fluid.

13. The method of claim 1 wherein the well fluid further comprises a gas-generating additive.

14. The method of claim 13 wherein the gas-generating additive is selected from the group consisting of: an aluminum powder and an azodicarbonamide.

15. The method of claim 13 wherein the gas-generating additive is present in the fluid in an amount in the range of from about 0.2% to about 5% by volume.

16. The method of claim 1 wherein the well fluid is selected from the group consisting of a viscosifier, an oxidizer, a surfactant, a fluid loss control additive, a dispersant, a tracer, and a weighting material.

17. The method of claim 16 wherein the tracer is a fluorescein dye, a tracer bead, or a mixture thereof.

18. The method of claim 1 wherein the well fluid further comprises an additive wherein the additive is sodium silicate, sodium metasilicate, potassium silicate, potassium metasilicate, or sodium acid pyrophosphate.

19. The method of claim 18 wherein the silicate or metasilicate is present in the well fluid in an amount in the range of from about 2% to about 12% by weight of the well fluid.

20. The method of claim 18 wherein the acid pyrophosphate is present in the well fluid in an amount in the range of from about 1% to about 10% by weight of the well fluid.

* * * * *